US006279880B1

(12) United States Patent
Hawks, Jr.

(10) Patent No.: US 6,279,880 B1
(45) Date of Patent: Aug. 28, 2001

(54) ONSITE TEMPORARY FALL PROTECTION SYSTEM

(75) Inventor: William Robert Hawks, Jr., Orlando, FL (US)

(73) Assignee: Onsite Safety Systems, Winter Park, FL (US)

( * ) Notice: Subject to any disclaimer, the term of this patent is extended or adjusted under 35 U.S.C. 154(b) by 0 days.

(21) Appl. No.: 09/378,521

(22) Filed: Aug. 20, 1999

(51) Int. Cl.[7] ..... E04H 17/14
(52) U.S. Cl. ..... 256/67; 256/65; 403/109.1
(58) Field of Search ..... 256/67, 59, 65, 256/DIG. 6; 403/109.1

(56) References Cited

U.S. PATENT DOCUMENTS

| | | | | |
|---|---|---|---|---|
| 5,431,372 | * | 7/1995 | Kostelecky | 256/64 |
| 5,452,880 | * | 9/1995 | Bailey | 256/67 |
| 5,683,074 | | 11/1997 | Purvis et al. | 256/67 |
| 5,842,685 | | 12/1998 | Purvis et al. | 256/67 |
| 5,876,011 | * | 3/1999 | Blasing | 403/109.1 X |
| 6,142,453 | * | 11/2000 | Martin | 256/65 |

* cited by examiner

*Primary Examiner*—Lynne H. Browne
*Assistant Examiner*—John R. Cottingham
(74) *Attorney, Agent, or Firm*—Brian S. Steinberger; Law Offices of Brian Steinberger

(57) ABSTRACT

Temporary and long term guard rail systems for use by residential and commercial builders on construction sites to prevent accidental falls that can result in serious bodily injuries. The systems meet the standards of fall protection as specified by OSHA including those on safety issues concerning protrusions that can cause lacerations and present clothing snag hazards. The system includes a plurality of vertical posts/stanchions having side rail mounting points that do not present laceration and clothing snag hazards. The posts/stanchions include rotatable collars with internally threaded holes that create mounting points for the side rails that are capable of rotating along the Y and Z axes of the posts/stanchions allowing the interconnection of horizontal guardrails. The side guardrails can include telescoping tubular adjustable lengths or have a fixed length. The adjustable version can be locked at selected lengths with an internal mechanism leaving no protrusions along the exterior of the horizontal length. The temporary/long term guard rail system can be used on balconies, elevated platforms, stair cases, and the perimeter of a floor prior to the external walls or permanent protective railing being erected to prevent accidental injury. Expandable and fixed length toeguard boards can run between posts/stanchions. The system can include load distribution support plates beneath each of the posts/stanchions that eliminate the need for tiedown straps. The support plates can include drainage holes to eliminate water buildup within the posts/stanchions. Mount plates can be used that can connect the system to existing flat wall and corner wall surfaces. The combination of inexpensive long term posts/stanchions and fixed length guard rails with the extremely versatile pivot stanchions and adjustable length guardrails, make this system a highly versatile safety device which is easy to install, easy to dismantle, and relatively inexpensive to manufacture.

22 Claims, 17 Drawing Sheets

1
1a
1b
1d
2
3
3a
3b
3g
4
4a
6a
6b
6d
7d
7e
8
A
Toe Board

Fig. 6
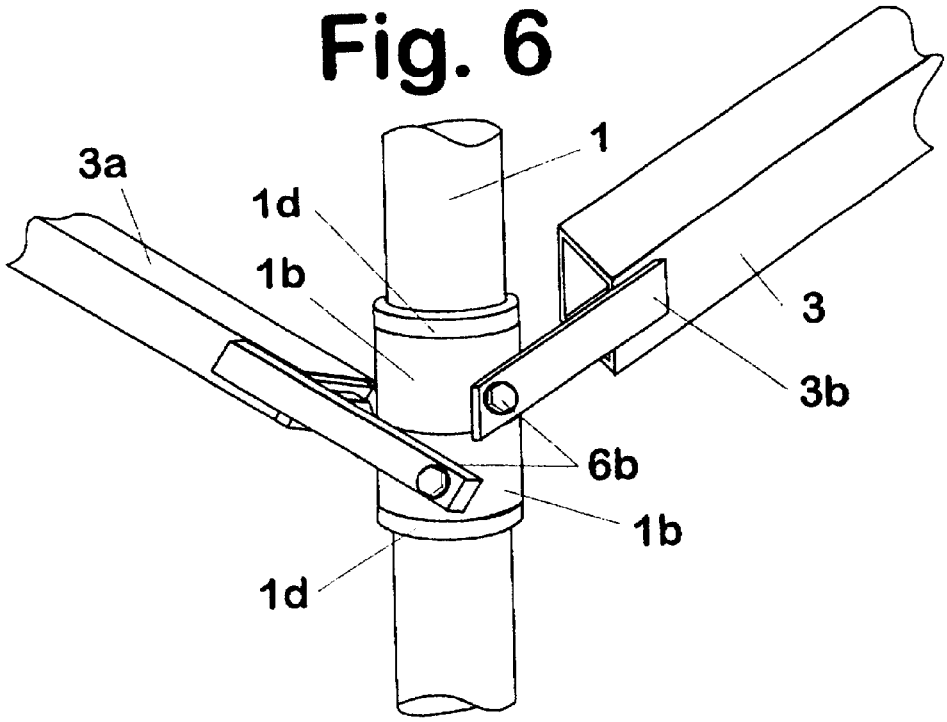
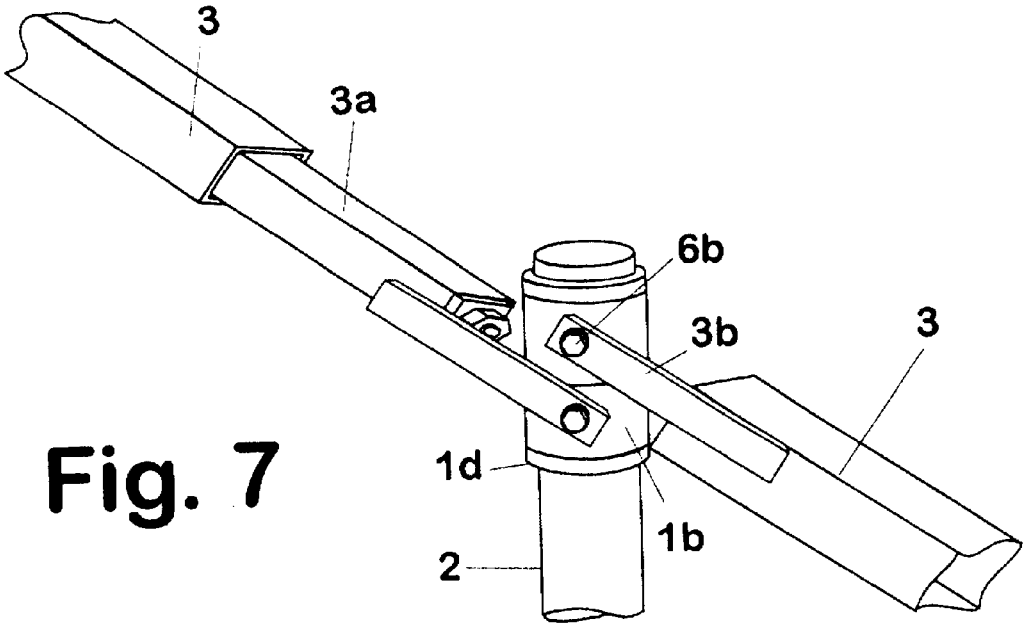
Fig. 7

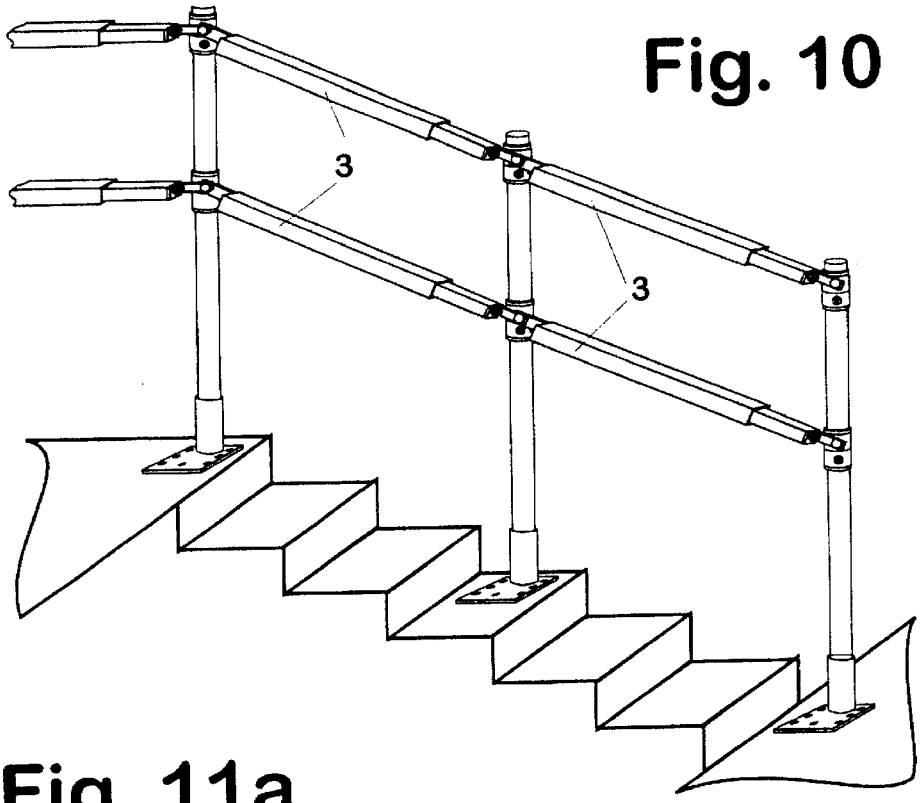
Fig. 10
Fig. 11a
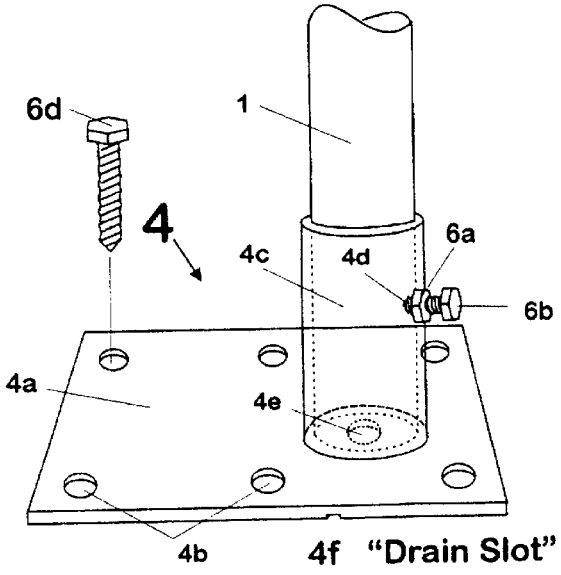
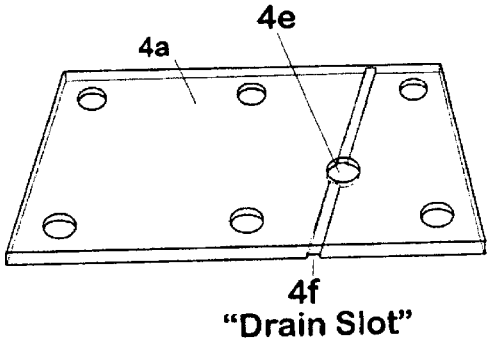
Fig. 11b

Fig. 19
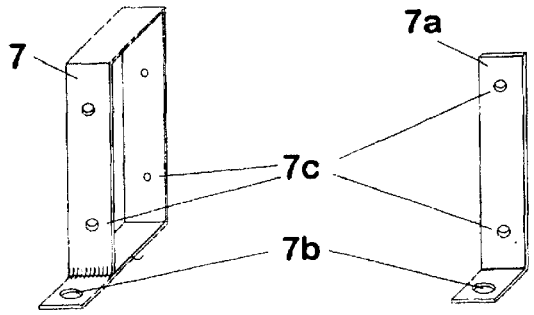
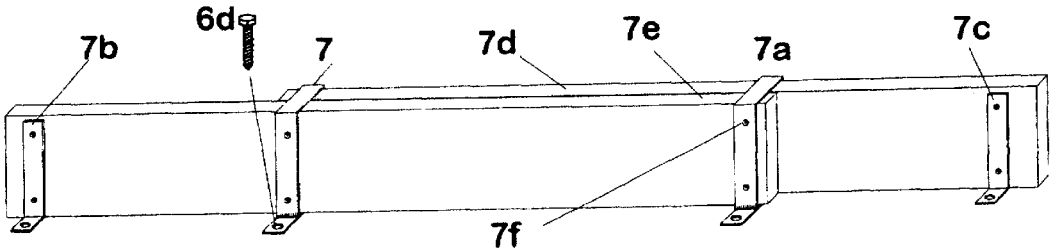
Fig. 20

Fig. 25
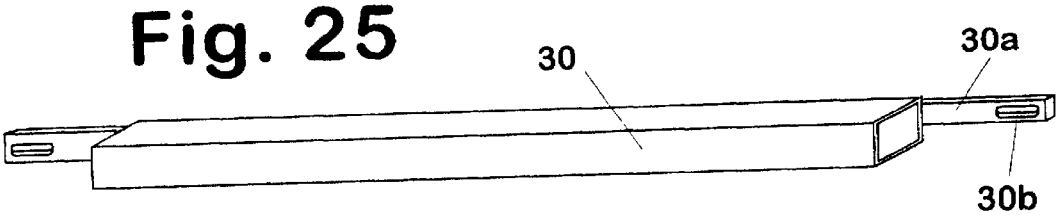
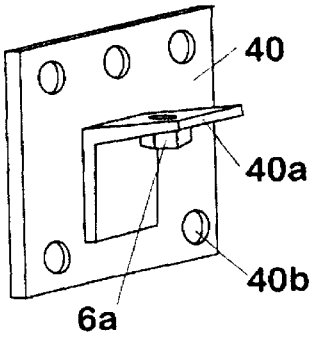
Fig. 26a
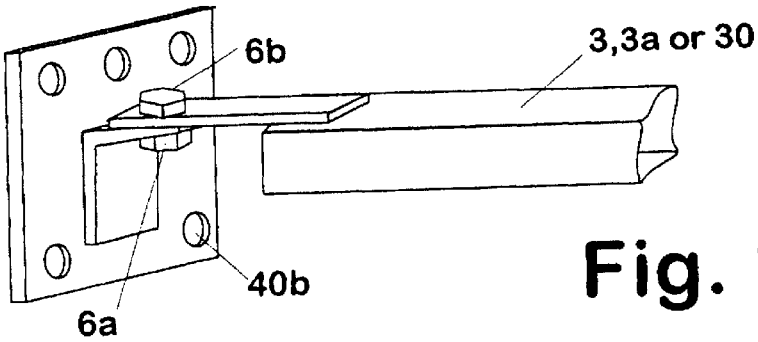
Fig. 26b

ONSITE TEMPORARY FALL PROTECTION SYSTEM

This invention relates to safety devices and more particular to temporary guard rails used on balconies and stairways during construction as onsite temporary fall protection systems.

BACKGROUND AND PRIOR ART

There has always been a need for providing safety guard rails prior to permanent railings being installed on decks, balconies, and on elevated floors during the construction of residential and commercial buildings and especially prior to the construction of exterior walls. The Occupational Hazards Safety Act(OSHA) has written specifications concerning the performance of temporary guardrails and handrails.

In Particular OSHA Standards 1926.1052 Stairways (c)(8) requires "Stair rail systems and handrails shall be so surfaced as to prevent injury to employees from punctures or lacerations, and to prevent snagging of clothing."

Aside from nailing up two-by-fours which takes considerable labor time, expense, and materials to assemble and are limited to only a single site application, various patents have been proposed to meet OSHA standards and would be reusable at different future sites.

U.S. Pat. No. 5,683,074 to Purvis et al. and its' continuation-in-part U.S. Pat. No. 5,842,685 to Purvis et al. each describes a "Temporary Guard Rail System(s)" that attempts to meet OSHA specifications. However, the Purvis patents fails to meet these OSHA specifications. Specifically FIGS. 1–9 of the '074 patent and FIGS. 3,4,5,6,7,8,9,12,13, 14,15,16, and 17 of the '685 patent clearly show exposed threaded bolts with large wing nuts, sharp edged brackets and adapters. The exposed thread(s) constitute a possible laceration threat and the combination of exposed bolt(s) and wing nut(s) constitutes a possible clothing snag hazard.

Furthermore, both the Purvis et al. '074 patent and the Purvis et al. '685 patent describe and show enlarged examples of the necessary adapters, brackets, and related components that must be used for both a balcony guardrail system and a stair case rail system. These adapters, brackets, and related components include sharp edged components such as metal type plates, threaded bolts, nuts, hexagonal nuts, wingnuts and the like, require a complex assembly that also presents a potential laceration and snag hazard during their construction.

Additionally, the Purvis et al. '685 patent in FIG. 16 uses a vertically extendible post having additional interior components that can result in excessive "play" in the extension portion of the post. The extension pipe along with other components results in a substantial addition of weight that must be transported and then hand carried to the installation location. Thus, the extra weight and assembly thereof causes extra labor costs to the user.

Furthermore, the Purvis et al. '685 patent employs the use of a leverage strap that connects the post/stanchion to the bottom plate, where significant space exists between the bottom plate and the bottom of the post/stanchion, and would constitute a trip hazard after installation to person(s) walking by the post/stanchion.

Both the Purvis et al. '074 patent and the '685 patent describes systems having many individual components that requires continuous maintenance. The exposed threads of the bolts that are welded or attached to the rail support collars, the various brackets, and at the top of each stanchion are often crushed and damaged and bent during handling, storage, and transport.

Purvis et al. '685 in FIG. 16 and Purvis et al. '074 in FIGS. 1–2 shows some rotatable collars on the guardrail posts. However, both the Purvis et al. patents require that the collars use outwardly projecting studs for mounting components thereto. Additionally, both Purvis et al. patents require that their posts use upwardly projecting vertical mounting studs for connecting top rails to the posts. Furthermore, both Purvis et al. patents require additional brackets for connecting the rails in stair applications. As previously mentioned outwardly projecting studs and additional brackets present serious problems.

Thus, the Purvis et al. '074 and '685 patents describe systems having multiple design flaws which would constitute significant problems in providing an OSHA compliant temporary guardrail system to be used in the construction industry.

Additionally, not all construction sites require the use of expensive highly adjustable safety guardrails. Commercial sites often require long straight runs of guardrails. Additionally, the commercial use of guardrails can be long term which can result in expensive versatile equipment being tied up for long periods. There is therefore a need for a simple but OSHA compliant guardrail system that can be used for these long straight runs, but can also be interconnected with the more versatile adjustable guard rail systems when the commercial site requires the ability of said flexible equipment.

Others have attempted to build guard rails but also fail to similarly meet the OSHA standards previously described. See for example, U.S. Pat. Nos. 2,910,135 to Moore; 5,314, 167 to Holloman; 3,351,311 to Melfi; 4,830,341 to Arteau, et al.; 3,662,993 to Lionetto; 5,182,889 to Johnson; 3,733, 054 to Storch; 3,863,900 to Dagiel, et al.; 4,015,827 to Brand; RE20,653 to Lamb; and 5,913,508 to Eades.

SUMMARY OF THE INVENTION

The first objective of the present invention is to provide an improved temporary guard rail system that meets all the OSHA requirements for temporary guardrails systems used for both balconies and stairwells, including those relating to laceration, clothing snag hazards, and trip hazards.

The second object of the present invention is to provide a temporary guardrail system for both balconies and stairwells that has fewer primary components than previous guardrails and thus is simpler to manufacture, stock, assemble, and maintain onsite.

The third object of the present invention is to provide a temporary guardrail system for balconies and stairwells that has fewer high maintenance components such as exposed stud threads and thus is simpler to maintain onsite.

The fourth object of the present invention is to provide a temporary guardrail system that offers the simplicity required of long straight runs of guard rails, with the smooth integration of more complex adjustable equipment.

The fifth object of the present invention is to provide a temporary guardrail system that does not require additional tie down straps for the posts/stanchions.

The sixth object of the present invention is to provide a temporary guardrail system that weighs less than existing temporary guardrail systems.

The seventh object of the present invention is to provide a temporary guardrail system having drainage capability for allowing the system to be used during wet weather conditions and reduces corrosion.

The eighth object of the present invention is to provide a temporary guardrail system that allows for horizontal side rails to be able to be mounted at predetermined heights on each upright post/stanchion.

The ninth object of the present invention is to provide a temporary guardrail system that allows all horizontal guardrails to be able to rotate a full 360 degrees about the point of attachment on each upright post/stanchion without any laceration and snag hazard protruding components.

The tenth object of the present invention is to provide a temporary guardrail system having guard boards(toe boards) to prevent items from falling off of balconies and landings.

The eleventh object of the present invention is to provide a temporary guardrail system that can be easily mounted and disassembled on both vertical and horizontal surfaces.

The preferred embodiments of the subject invention includes a plurality of improved vertical posts or stanchions that can be firmly attached to floors, flat roofs, elevated platforms, and flights of stairs. These stanchions can be of two different embodiments, (a) long term simple stanchions without rotating mounting collars, or, (b) highly flexible stanchions with rotating mounting collars. Either stanchion can be interconnected with either fixed length horizontal guard rails or internally locking adjustable horizontal guardrails vertically spaced and parallel. Both vertical stanchions represent an improvement over the prior art systems in that the subject invention does not present a laceration or clothing snag hazard. Additionally, the vertical stanchion with the rotating mounting collars represent additional improvements over the prior art in at least four specific ways. First, the improved mounting points do not present exposed threads or wing nuts and thereby lesson the risk of laceration or clothing snags. Additionally, the subject invention's improved mounting points include an unexpected additional benefit as they lock the mounting collar to the stanchion minimizing the inherent "play" or slack in the mounting collar. Second, the mounting point configuration of the subject invention eliminates the need of requiring separate brackets and adapters. For example, the subject invention eliminates some five separate brackets which must be purchased, stocked, transported, and then assembled, each of which additionally presents a laceration/clothing snag hazard as would be required by both the Purvis et al. '074 and '685 patents. Third, the subject invention eliminates the need for post/extension members that are used in prior art systems such as that shown in FIG. 16 of the Purvis '685 patent, thus resulting in less weight. Fourth, the subject invention does not have the loose play in the assembled posts/stanchions that comes with other prior art systems.

Each of the improved upright stanchions of the temporary guard rail of the subject invention include an anchor bracket integrally formed therewith for attaching the upright stanchions to the sub floor or framing members of the building under construction. The anchor brackets are provided with a plurality of mounting holes to permit the attachment of the same to the building structure with lag screws or other suitable fasteners.

The subject invention can further include an anchor plate drain hole combined with the drain slot allow any moisture that might collect in the anchor cup to be drained. This improvement is critical for long term exterior installations where adverse weather can cause eventual corrosion and thus result in equipment failure.

The subject invention allows for guard rails to be mounted at a predetermined height on each upright stanchion. The flexible pivot stanchion provides rotating mounting collars that permit the horizontal side rails to be rotated a full 360 degrees about the point of attachment on each upright stanchion either horizontally or at an angle without a protruding bolt or wing nut which presents a laceration or snag hazard. Thus, the guard rails can be adapted to virtually any configuration encountered in a building under construction presenting a complete OSHA compliant guardrail system.

The subject invention can further include an adjustable toe board assembly that prevents items from being bumped or pushed off of a balcony or landing. The novel system is lightweight, flexible, and easy to install and maintain.

The temporary guard rail system invention can further include additional anchor systems allowing the system to be installed on vertical surfaces as well as horizontal surfaces.

Further objects and advantages of this invention will be apparent from the following detailed description of a presently preferred embodiment which is illustrated schematically in the accompanying drawings.

BRIEF DESCRIPTION OF THE FIGURES

FIG. 6 is a perspective view of a connection of two guardrails to a pivot stanchion, which shows that the novel mounting arrangement does not present a laceration or clothing snag hazard.

FIG. 7 is a perspective view of an upper guardrail attachment to the top of a pivot stanchion. The offset attachment of guardrail mounting tang **3*b*** enables the two guardrails to be attached at different heights, but still maintain similar overall height to meet the OSHA height standard for hand rails. This view shows that the novel mounting arrangement does not present a laceration or clothing snag hazard.

FIG. 10 is a perspective view of a stair rail assembly transitioning to a short pivot stanchion guardrail system without the use of any additional brackets as is required by prior art systems.

FIG. 11*a* is an enlarged view of the novel stanchion anchor of the preceding figures that eliminates unwanted play in the post/stanchion as well as not presenting a laceration or clothing snag hazard, along with the novel drain hole and slot.

FIG. 11*b* shows the drain hole and drain slot of FIG. 11*a*.

FIG. 19 is a perspective view of the brackets used with the toe board in FIGS. 1 and 8.

FIG. 20 shows an assembled toe board used in FIGS. 1 and 8 with the brackets of FIG. 19.

FIG. 25 is a perspective view of a single fixed length guard rail used in FIG. 24.

FIG. 26*a* is a perspective view of a novel guard rail wall mounting plate that can be used.

FIG. 26*b* is a perspective view of a guard rail attached to a wall mounting plate of FIG. 26*a*.

FIGURE PARTS LIST

W Weld
1 Rotating Mounting Point Tall Stanchion
1*a* Stanchion Top Cap
1*b* Mounting Collar
1*d* Mounting Collar Location Bracket
2 Rotating Mounting Point Short Stanchion
3 Adjustable Guard Rail External Segment
3*a* Adjustable Guard Rail Internal Segment
3*b* Guard Rail Mounting Tang
3*c* Adjustable Guard Rail Locking Bracket
3*d* Adjustable Guard Rail End Plate
3*e* Adjustable Guard Rail Mounting Tang Hole
3*f* Adjustable Guard Rail Adjustment Rod
3*g* Adjustable Guard Rail Adjustment Nut
3*h* Adjustable Guard Rail Locking Bracket Slide Surface
3*j* Adjustable Guard Rail Inner Tube Slide Surface
4 Stanchion Anchor
4*a* Stanchion Anchor Bracket
4*b* Stanchion Anchor Bracket Mounting Holes
4*c* Stanchion Receiver Cup
4*d* Stanchion Side Hole For Locking Bolt
4*e* Stanchion Anchor Bracket Drain Hole
4*f* Stanchion Anchor Bracket Drain Groove
5 Load Distribution Plate
5*a* Load Distribution Plate Mounting Hole
6*a* Machine Nut
6*b* Machine Bolt
6*c* Long Machine Bolt
6*d* Mounting Lag Bolt
6*e* Stanchion Wall Anchor Machine Bolt
6*f* Stanchion Wall Anchor Machine Nut
6*g* Internal Threads within Nut 6*a*
6*h* Side Hole In Rotatable Collar 1*b*
7 Toe Board Sliding Mounting Bracket
7*a* Toe Board Mounting Bracket
7*b* Toe Board Mounting Hole
7*c* Toe Board Small Mounting Hole
7*d* Toe Board Rear Board
7*e* Toe Board Forward Board
7*f* Toe Board Small Mounting Bolt
10 Fixed Mounting Point Tall Stanchion
20 Fixed Mounting Point Short Stanchion
30 Fixed Length Guard Rail
30*a* Fixed Length Guard Rail Mounting Tang
30*b* Fixed Length Guard Rail Mounting Slot
40 Wall Mounting Plate
40*a* Wall Mounting Plate Bracket
40*b* Wall Mounting Plate Hole
50 Wall Anchor Plate
50*a* Wall Anchor Extension
50*b* Wall Anchor Receiver Cup
50*c* Wall Anchor Mounting Hole
50*d* Wall Anchor Receiver Cup Adjustment Hole
51 Wall Comer Anchor Plate
51*a* Wall Comer Anchor Extension
51*b* Wall Comer Anchor Receiver Cup
51*c* Wall Comer Anchor Mounting Hole
51*d* Wall Comer Anchor Receiver Cup Adjustment Hole
100 Deck
100*a* Wall

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
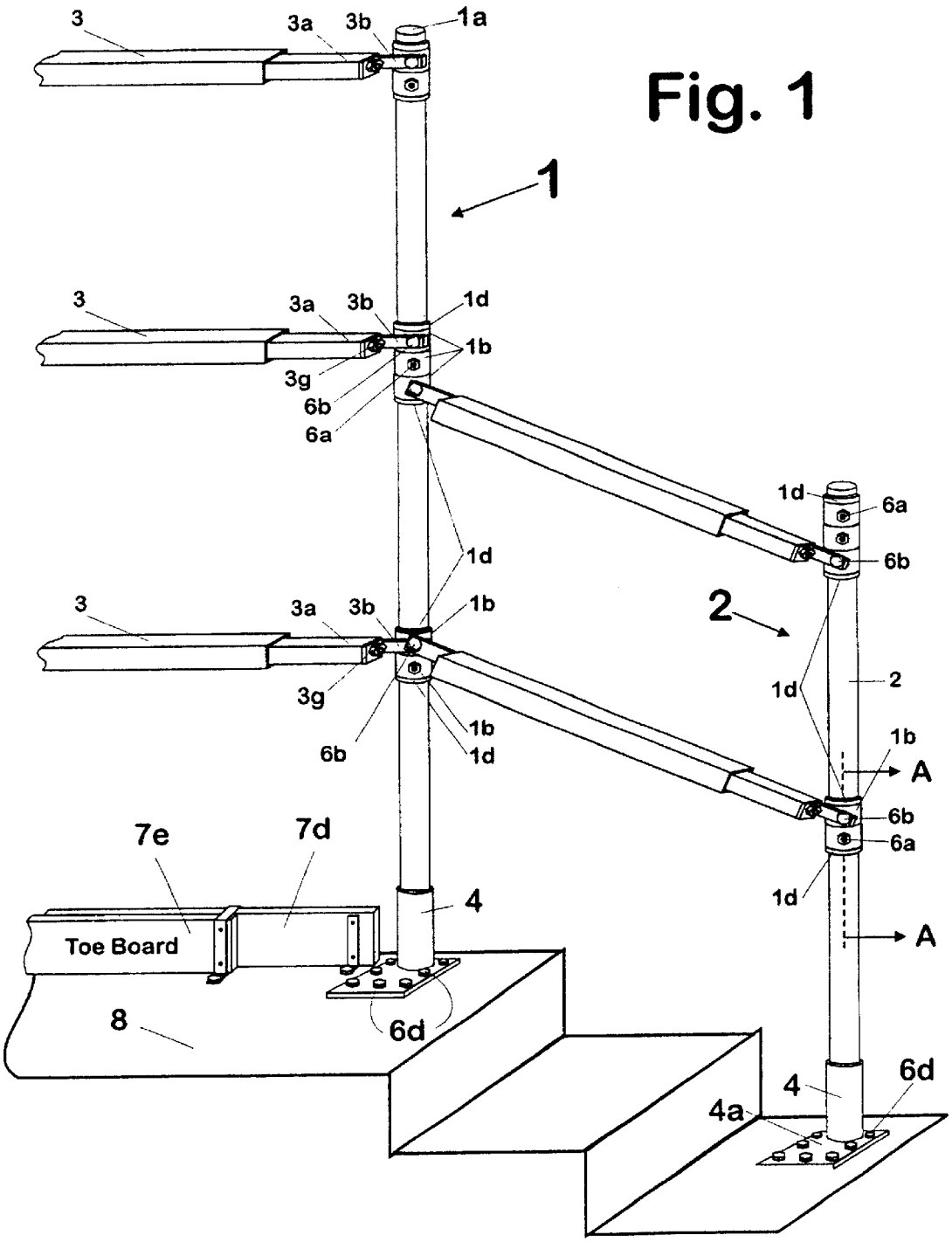
FIG. 1 is a perspective view of the short pivot post/stanchion, tall pivot post/stanchion, post/stanchion anchors, toe board and interconnecting guard rails used in the subject invention.

The temporary guardrail of the present design is disclosed in two embodiments. A flexible residential embodiment is illustrated in FIG. 1. The temporary guard rail system illustrated comprises a tall upright pivot post/stanchion 1 with a short upright pivot post/stanchion 2. The posts/stanchions 1 and 2 can be formed from heavy steel pipe in order to comply with OSHA strength regulations. Additionally other materials such as aluminum, fiberglass and similar composites can also utilized. The lower end of each pivot stanchion 1 and 2 is fixed to a building subfloor surface 8 such as steps or a balcony by an anchor bracket 4. In the preferred embodiment, stanchions 1, 2 are positioned in a predetermined location on anchor bracket 4 and can be attached in perpendicular relation thereto by weldment FIG. 1 and other techniques such as those shown in FIG. 12.

Referring to FIGS. 11*a*–13, anchor bracket 4 can include an upright cylindrical cup 4*c* for receiving the lower end of a post/stanchion 1. Perpendicular to cylindrical cup 4*c* is a base plate 4*a* having a plurality of mounting apertures 4*b* extending there-through in predetermined locations. Mounting holes 4*b* each have a center axis that is disposed in perpendicular relation to the plane of anchor bracket 4*a*.

Anchor bracket 4*a* may be securely attached to building subfloor 8 by installing a plurality of fasteners 6*d* such as but not limited to lag screws and the like, which secure stanchions 1 and 2 in position as illustrated in FIG. 1.

Referring now to FIGS. 11*a*, 11*b*, 12 and 13, anchor bracket 4*a* is shown for attaching each stanchion 1 or 2 to the building subfloor or other suitable framing members. Anchor bracket 4*a* includes a cylindrical cup 4*c* that is positioned in a predetermined location on anchor bracket 4*a* and is fixably attached in perpendicular relation thereto by weldment and the like.

Cup 4*c* can include an internal bore having an inside diameter that is slightly larger than an outside diameter of the bottom portions stanchions 1 and 2. Thus, cup 4*c* is adapted to receive a lower end of stanchion 1 or 2 therein.

Cup 4*c* can include a drilled hole 4*d* large enough to receive a bolt 6*b* matching a machine threaded nut 6*a* or equivalent which has been attached to the exterior of cup 4*c* by weldment or other suitable attachment directly over said drilled hole. The result being a bolt 6*b* can be threaded into the threaded nut 6*a* and then tightened so that the bolt 6*b* will extend through the wall hole 4*d* of cup 4*c* and come into contact with the exterior of stanchion pipe 1 and 2 thus eliminating all play from said assembly, and lock the posts/stanchions 1, 2 to the cylindrical cup 4*c*. It should be noted that said bolt 6*b* can be of just sufficient length and size to thoroughly tighten against the posts/stanchions without protruding excessively which would constitute a snag hazard.

Referring to FIGS. 11*a*–11*b*, it will be appreciated that post/stanchion 1 is positioned at a predetermined location on anchor bracket 4*a* which is offset in a lateral direction from a center point of the top surface of anchor bracket 4*a*. Referring to FIG. 11*b*, it will be appreciated that the drain hole 4*e* and the diagonally cut drain slot 4*f* enable any water that should find its way into the post/stanchion either through rain, snow, or condensation to be drained from the post/stanchion anchor receiver cup 4*c*. This can be a critical issue in long term exterior installations. Without drainage hole 4*e* and drain slot 4*f*, moisture can result in corrosion and possible equipment failure.

Referring to FIG. 1, posts/stanchions 1 and 2 include a pair of rail stops 1*d* about each set of rotatable collars 1*b*. Each pair of rail stops 1*d* include an upper rail stop and a lower rail stop 1*d*. Rail stops Id can be fabricated as steel rings having an axial opening that is slightly larger than the outside diameter of posts/stanchions 1, 2. Upper and lower rail stops Id are disposed about the outside diameter of posts/stanchions 1, 2 and positioned at a predetermined vertical height generally corresponding to the vertical height of lower and middle, and upper adjustable horizontal guard rails 3 as shown in FIG. 1.

Figure 2:
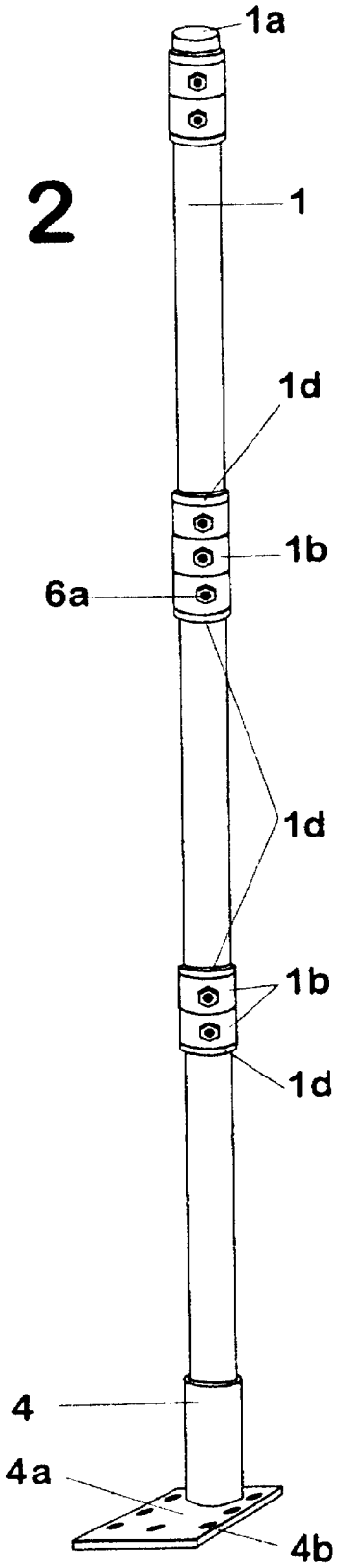
FIG. 2 shows the tall pivot post/stanchion of FIG. 1.
Figure 3:
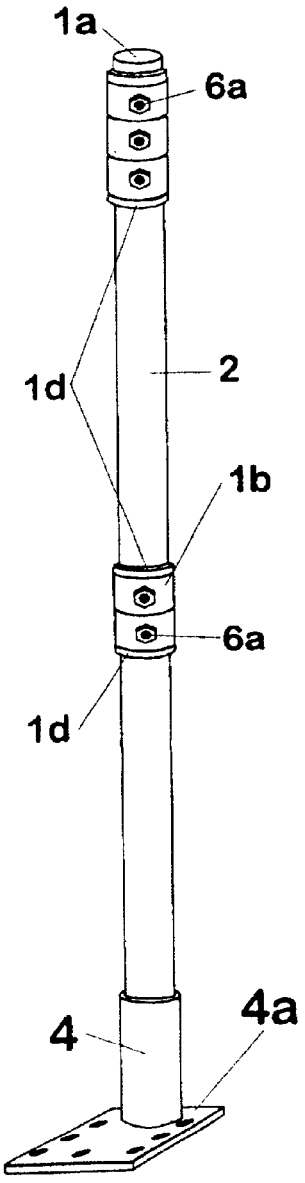
FIG. 3 shows the short pivot post/stanchion of FIG. 1.

Referring to FIGS. 1, 2 and 3, upper and lower mounting collar location brackets 1*d* are disposed about each of the posts/stanchions 1, 2 in perpendicular relation to the longitudinal axis thereof. Lower mounting collar location brackets 1*d* on each of the posts/stanchions 1, 2 are positioned in spaced relation from each other to accommodate the installation of two or more mounting collars 1*b* there between as clearly seen in FIGS. 2 and 3.

In the preferred embodiment, mounting collars 1*b* can also be fabricated from steel. Each of the collars 1*b* having an axial opening that is somewhat larger than the outside diameter of posts/stanchions 1, 2 enabling mounting collars 1*b* to be freely rotated up to 360 degrees about the longitudinal, Y axis of posts/stanchions 1, 2.

Figure 4:
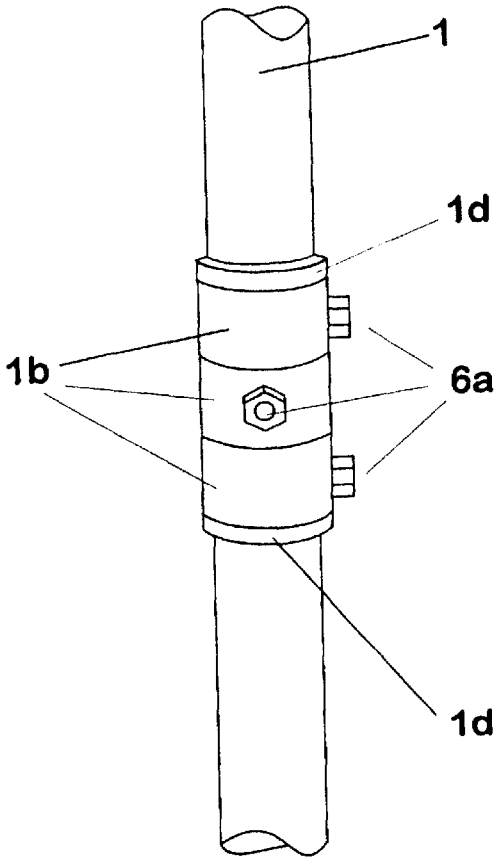
FIG. 4 is an enlarged view of the guardrail connection points at the mid rail/hand rail connection point on the tall pivot stanchion of FIGS. 1 and 2. These novel feature allow a stair rail assembly (comprised of short pivot posts/stanchions) to directly transition to a balcony configuration of tall pivot stanchions without any additional brackets.
Figure 5:
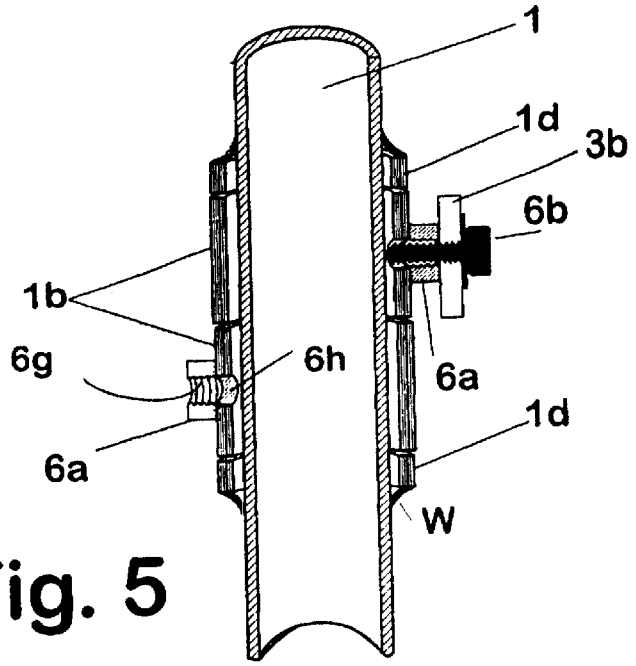
FIG. 5 is an enlarged cross-sectional view of the bottom right guard rail connection point shown in FIG. 1 along arrow A, which illustrates the connecting bolt passing through the mounting/rotation collar to make contact with the stanchion pipe. This bolt therefore not only connects the guardrail to the stanchion, but it additionally locks the rotation of the collar, thereby removing play from the assembly.

Formed on the outside diameter of mounting collars 1*b* are at least one threaded nut 6*a* in perpendicular relation to the longitudinal Y axis of posts/stanchions 1, 2 as shown in FIG. 4. FIG. 5 is an enlarged cross-sectional view of the bottom right guard rail connection point shown in FIG. 1 along arrow A. Each nut 6*a* has an internally threaded through-hole 6*g*.

Referring to FIG. 5, threaded nuts 6*a* are fixably attached to the exterior surface of mounting collars 1*b* by weldment or other suitable means. Additionally there is a hole 6*h* drilled through collars 1*b* directly behind nuts 6*a* so that a suitable bolt 6*b* can be threaded through the nut 6*a* and through the hole 6*h* so that the bolt 6*b* will come into contact with an exterior surface portion of posts/stanchions 1, 2, thus simultaneously attaching an adjustable guard rail to the stanchion and locking the rotation of the mounting collar 1*b*.

During the manufacturing process of posts/stanchions 1 and 2 shown in FIG. 2, lower mounting collar location brackets 1*d* with at least two rail support collars 1*b* there between are slideably positioned at predetermined locations on posts/stanchions 1, 2. After the aforesaid components are precisely located in their operative positions, mounting collar location brackets 1*d* are fixably attached to posts/stanchions 1, 2 by weldment thereby permanently retaining rotatable mounting collars 1*b* between each pair of brackets 1*d*. Rotatable mounting collars 1*b* remain freely rotatable 360 degrees about the longitudinal Y axis of posts/stanchions 1, 2. It will be noted from FIGS. 2 and 3 that said collars 1*b* are used for the attachment of lower, mid and upper guard rails 3. Additionally it should be noted from FIGS. 1 and 10 that these same mounting collars, 1*b* also are used to attach the stair rails without the use of any additional hardware or brackets.

Referring to FIG. 6, it can be seen that each end of all horizontal guard rails 3, 3*a* includes a guard rail mounting tang 3*b* that is fixably attached in substantial linear alignment thereto by weldment, and the like. Guard rail mounting tangs 3*b* additionally are attached along the upper edge of side rail 3 and 3*a* as shown in FIGS. 7,10, 14, 15 and 16. The offset attachment of these mounting tangs 3*b* enables the side rails 3, 3*a* to be installed in such a way as to reduce the difference in elevation between rails extending in either direction from the posts/stanchions 1, 2. The offset effectively eliminates the potential height variation that would result in the two guard rail mounting tangs 3*b* being attached to the posts/stanchions 1, 2 at two similar, but different heights. Guard rail mounting tangs 3*b* include at least one mounting aperture through which threaded bolt 6*b* can be inserted into nut 6*a*(FIG. 5) to mount all horizontal side rails 3, 3*a* in their functional position as shown in FIGS. 6–7.

Referring to FIGS. 6–7, guard rails 3, 3 can now be rotated in a horizontal plane or pivoted vertically to conform to the shape of the building structure where it will be deployed and that this rotation is accomplished without creating a laceration or clothing snag hazard from protruding studs or wing nuts.

Figure 8:
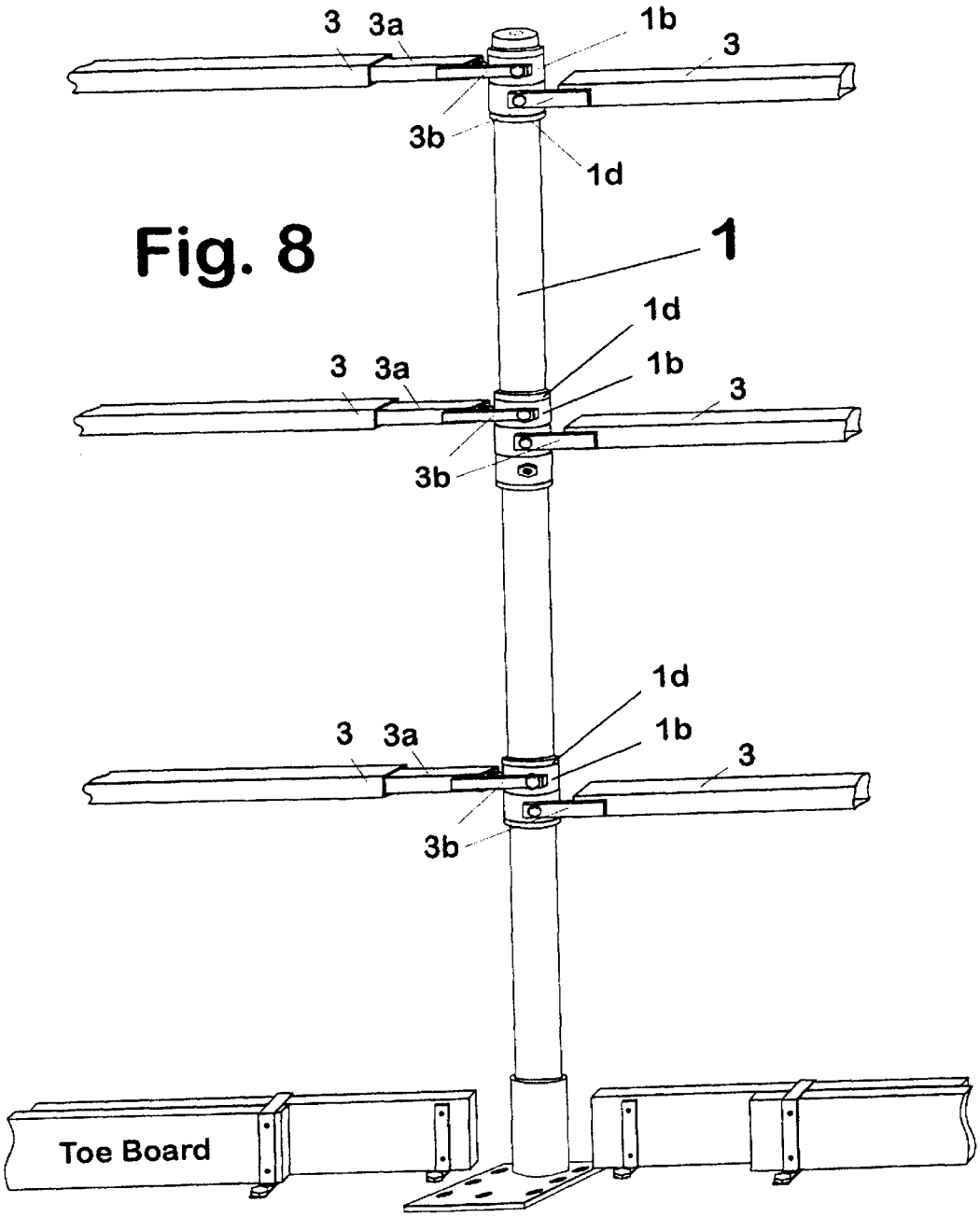
FIG. 8 is a perspective view of the connection of guardrails at the top, mid rail, and lower point on a tall pivot stanchion along with a toe board. This view shows that the novel mounting arrangement does not present a laceration or clothing snag hazard.
Figure 9:
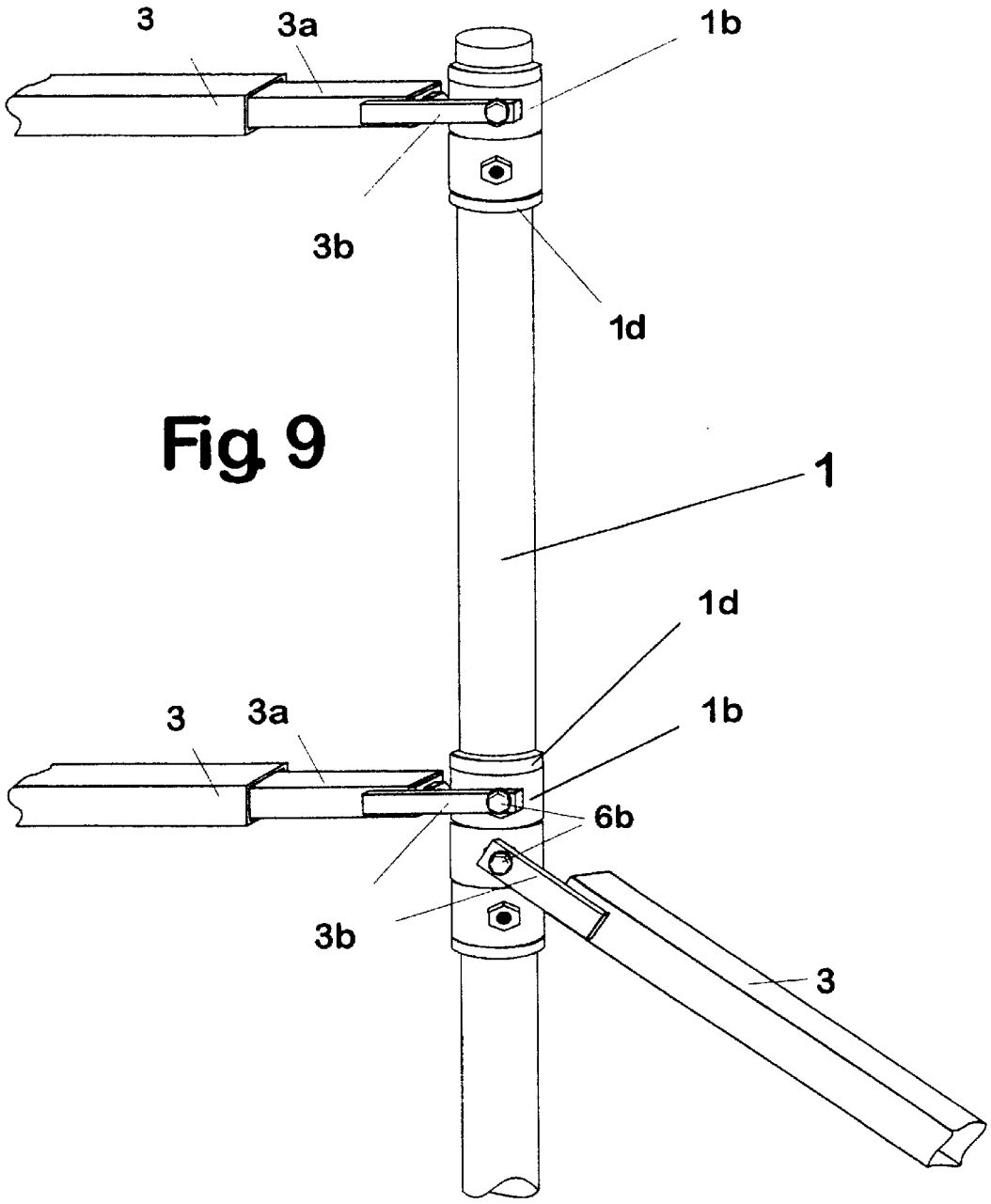
FIG. 9 is a perspective view of an alternate connection of guardrails to a tall pivot stanchion. This view illustrates the flexibility of the invention of using a tall post/stanchion interconnecting with a stair rail assembly without additional brackets as required in prior art systems.

Referring to FIG. 8, guard rail extension brackets 3*b* and their corresponding upper, middle, and lower guard rails 3, 3*a* can be positioned over a respective threaded nut 6*a* and secured in this position by insertion and fastening of bolt 6*b*. As compared to prior art systems previously described, this method of attachment is a superior method that reduces possible laceration or clothing snag hazards.

It will further be appreciated that lower, middle and upper horizontal side rails 3, 3*a* can also be rotated 360 degrees in perpendicular relation to the longitudinal Y axis of posts/stanchions 1, 2 to conform to the shape of the building structure and construction site where it is to be utilized before the bolts 6*a* are tightened. It will also be appreciated that as soon as said bolts 6*a* are securely tightened, the ability of mounting collars 1*b* to rotate around the post/stanchion 1, 2 will be removed, thus effectively locking side rails 3 and 3*a* securely in place.

Referring to FIGS. 14, 15, 16, 17 and 18, there is shown therein a detailed view of the internally locking adjustable telescoping guard rail 3 of the present invention. In the preferred embodiment, guard rail 3 is composed of two individual segments, namely internal segment 3*a* and external segment 3. It will be understood that both internal segment 3*a* and external segment 3 can be fabricated from steel tubing that can be generally rectangular in cross section. In particular, internal segment 3*a* can be fabricated to an outside dimension that is slightly smaller than the inside dimension of external segment 3.

Accordingly, internal segment 3*a* can be slideably engaged with the inside surface of external segment 3 in a telescoping manner. Hence, horizontal side rails 3 can be adjusted to selected lengths to conform to the dimensions of the building structure on the construction site where it is to be installed.

Figure 18:
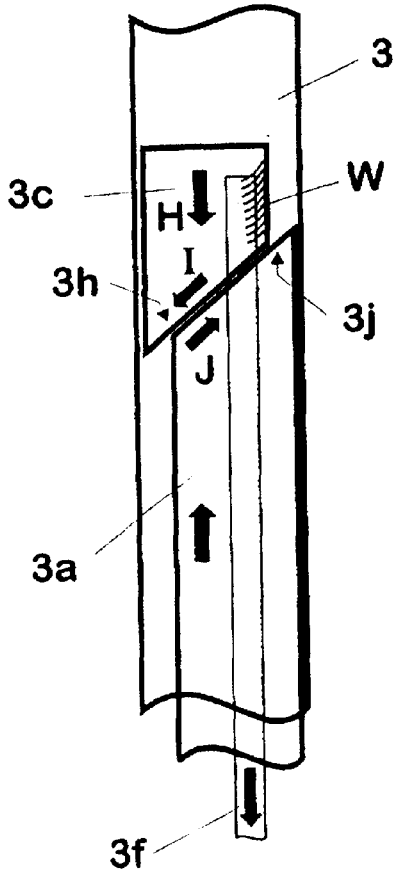
FIG. 18 is an enlarged view of the locking mechanism of FIG. 17 showing the mechanical movement and forces to enable the internal locking mechanism to operate.

The telescoping ends of internal segment 3*a* and external segment 3 can be provided with a suitable locking means, such as that indicated generally at 3*c*, for securing the telescoping side rail in a fixed position after it has been adjusted to the selected length. Locking bracket 3*c* is attached to threaded rod 3*f* which is located inside of internal segment 3*a*. A small threaded portion of rod 3*f* protrudes through bracket 3*d* by means of a suitable hole in the face of said bracket. Additionally, bracket 3*d* is permanently fixably attached to internal segment 3*a* typically by weldment and the like. The protruding threaded portion of rod 3*f* is terminated by threaded nut 3*g* on the outside end face of internal segment portion 3*a*. It can be appreciated that when threaded nut 3*g* is tightened in a clockwise direction upon threaded rod 3*f*, the length of threaded rod 3*f* becomes shorter. This shortening of threaded rod 3*f* results in locking bracket 3*c* being pulled towards bracket 3*d* in the direction of arrow H. FIG. 18 illustrates the forces that enable the locking to be accomplished. Locking bracket 3*c* is pulled forward in the direction of arrow H by threaded rod 3*f* forcing surfaces 3*h* and 3*j* to make contact. Continued tightening of nut 3*g* and the continued shortening of rod 3*f* demands that locking bracket 3*c* be forced outward in the direction of arrow I in relation to rail 3*a*. Simultaneously a portion of interior segment 3*a* moves in the opposite direction along arrow J. The sliding motion outward will continue until locking bracket 3*c* and rail 3*a* make contact with opposite internal sides within hollow external rail 3. It will be appreciated that sufficient turns applied to nut 3*g* will result in substantial force being applied outward to rail 3 and locking bracket 3*c* resulting in the internal rail segment 3*a* becoming securely locked to the external segment 3. It will be appreciated that a few loosening turns of nut 3*g* will result in a lengthening of threaded rod 3*f*. This lengthening will result in locking bracket 3*c* sliding along the diagonal faces 3*h*, 3*j* of internal segment 3*a* and locking bracket 3*c*, thus resulting in a loosening of the internal segment 3*a* in relationship with the external segment 3.

Figure 14:
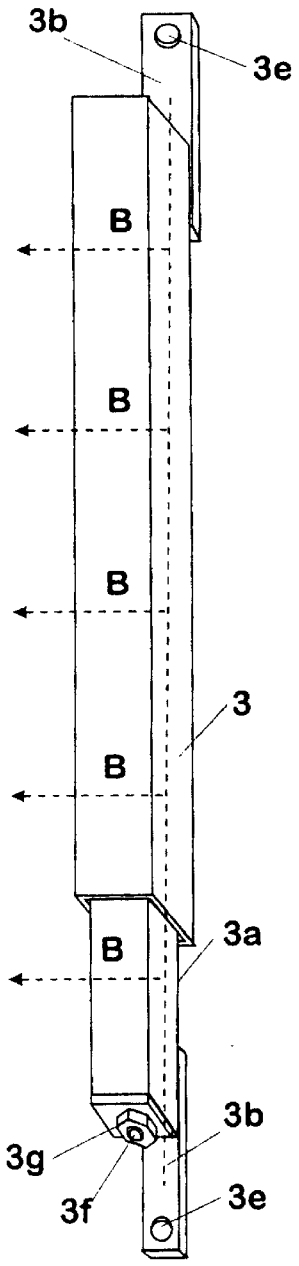
FIG. 14 is a perspective view of an internally locking guard rail that can be used in the invention.
Figure 15:
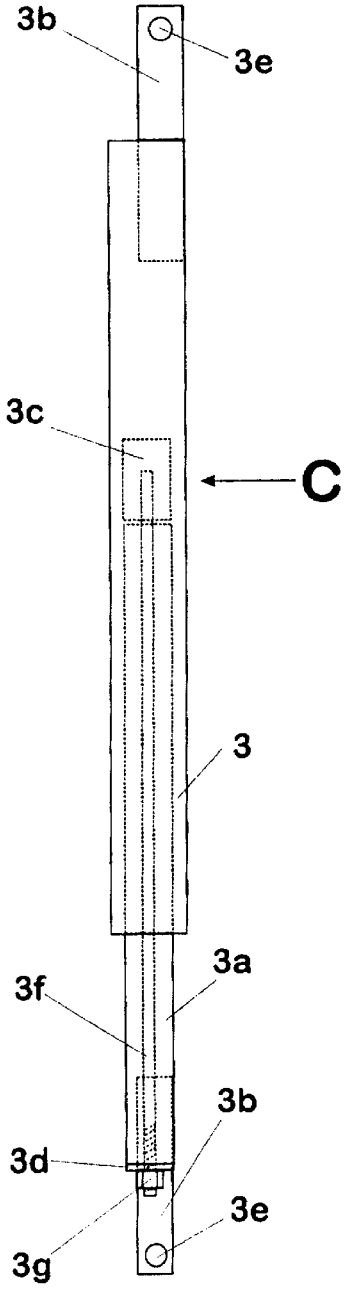
FIG. 15 is a cross-sectional view of the internally locking guard rail of FIG. 14 along arrow B.
Figure 16:
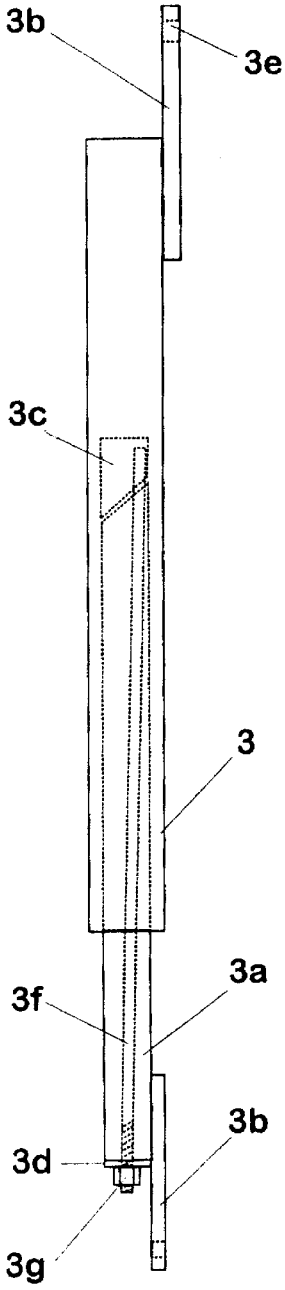
FIG. 16 is a side view of the internally locking guard rail of FIG. 15 along arrow C.
Figure 17:
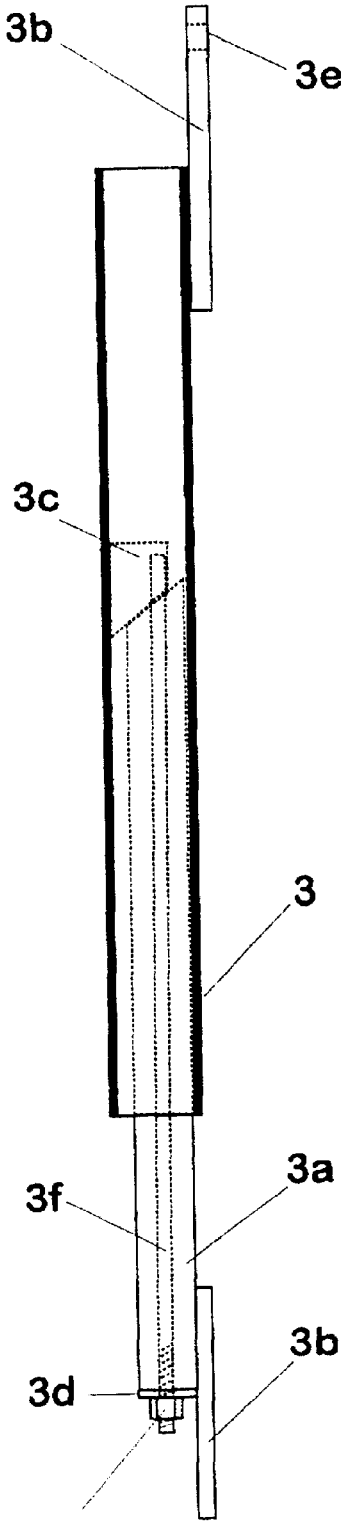
FIG. 17 is a view of the guard rail of FIG. 16 with the locking mechanism engaged.

Each of the respective telescoping guard rails 3, 3*a* shown in FIGS. 14, 15 and 16 can be manufactured to the same general specifications and, thus, lower, middle, and upper side rails can be functionally interchangeable.

Referring to FIG. 20, there is shown therein a perspective view of the telescoping toe board 7*d*, 7*e* of the present invention. In the preferred embodiment, the toe board can be comprised of two individual sections, segments 7*d* and 7*e*. Both segments 7*d* and 7*e* can be fabricated from wood, plastic, steel tubing, or other suitable material that is generally rectangular in cross-section. In particular, segments 7*d* and 7*e* can be fabricated to an outside dimension that when combined is slightly smaller than the inside dimension of bracket 7 or 7*a*.

Segments 7*d* and 7*e* can be slidingly engaged along a common surface in a telescoping manner. Hence, the toe board can be adjusted in length to conform to the dimension of the building structure on the construction site in a manner similar to that of the telescoping side rails 3, 3*a* previously described.

FIG. 19 illustrates the shape and configuration of brackets 7 and 7*a* which hold the toe board segments 7*d* and 7*e* in place. It can be seen from FIG. 20 that when segment 7*d* has bracket 7 attached at its left end by means of fasteners 7*f* such as bolts and screws through the bracket holes 7*c*, a resulting an aperture opening is created of sufficient size that segment 7*e* can easily slide therethrough in a horizontal fashion. Additionally it can be seen from FIG. 20 that when segment 7*e* has bracket 7*a* attached at its right end by means of fasteners 7*f* such as bolts and screws through the bracket holes 7*c*, a resulting aperture opening is created of sufficient size that segment 7*d* can easily slide in a horizontal fashion.

In application, toe board 7*d*, 7*e* can be positioned intermediate an adjacent pair of upright posts/stanchions 1, 2 and telescopingly adjusted to the required length and secured in position by fasteners 6*d* such as lag screws, and the like to a subfloor surface through mounting holes 7*b* as illustrated in FIG. 20. The toe board functions to prevent tools and other materials from accidentally being pushed over the edge of the staircase or balcony whereon the temporary guard rail system is installed and onto persons below thereby preventing potential injury.

The toe board of FIG. 20 can withstand in excess of 50 pounds of outward pressure applied thereto in accordance with OSHA standards.

Figure 12:
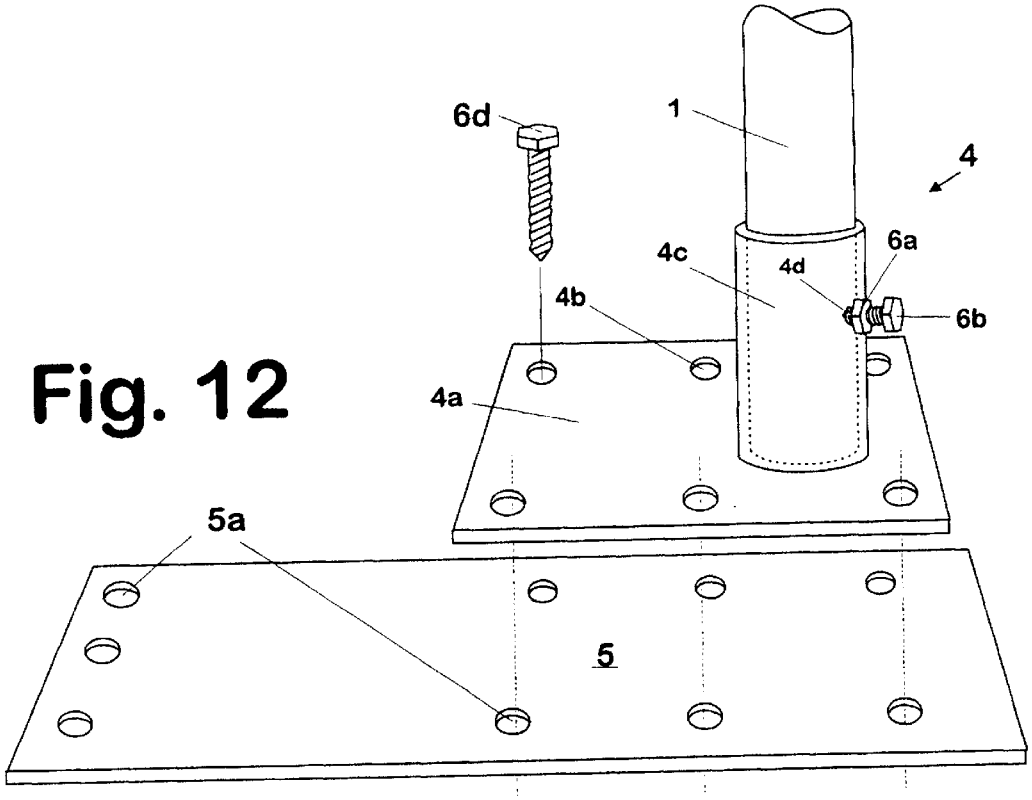
FIG. 12 is an enlarged exploded view of the anchor load distribution plate that can be installed underneath a stanchion anchor of FIGS. 11*a*–11*b*, which eliminates the need for any tie down strap.
Figure 13:
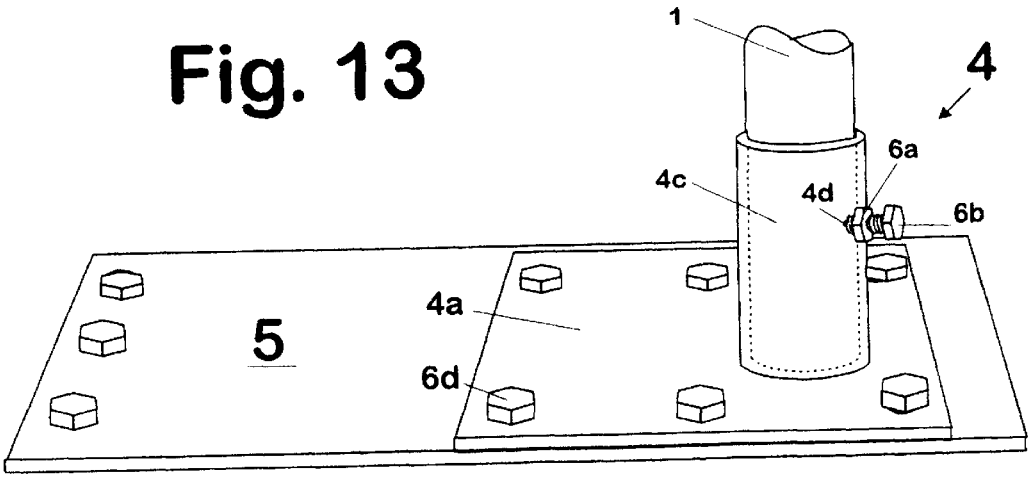
FIG. 13 shows the anchor load distribution plate with the stanchion anchor of FIG. 12 assembled.

Referring to FIGS. 12–13, there are situations where an enlarged anchor plate 5 is needed to more securely distribute the load weight of the overall temporary guard rail system. When installing a tall post/stanchion 2 on the first or last post/stanchion in the temporary guard rail system which is unsupported by an adjacent stanchion 1, 2, the use of an enlarged anchor plate 5 can be required to meet OSHA standards. Enlarged anchor plate 5 includes an elongated steel plate 5 having various apertures 5*a* drilled or punched through said plate in a specific pattern that enables a post/stanchion anchor 4 to be placed vertically over said enlarged anchor plate 5 in such a way that the mounting holes 4*b* align with mounting holes 5*a*. It can be seen that lag screws 6*d* can be screwed through mounting plate holes 4*b*, 5*a* and into the deck surface below.

Typical decking on a multi floor residence is usually plywood or an equivalent. The decking is prone to flexing under the stresses present when outward force is applied to an upper guardrail on a tall stanchion. It can be appreciated that the use of enlarged anchor plate 5 results in a larger foot print of the Anchor Plate assemble. This larger foot print enables the forces that result when outward pressure is applied to the upper guard rail on a tall stanchion 2, to be distributed over a larger portion of the floor or decking resulting in less movement and hence greater safety.

A second embodiment of the present invention is shown in FIGS. 21, 22, 23, 24 and 25. Long term post/stanchion 10 is directly fixably attached to its anchor bracket 4*a* through weldment, and the like. Anchor bracket 4*a* can then be firmly attached to deck surface by removable fastener means previously described such as lag bolt, and the like.

Upper, middle and lower fixed length guard rails 30 are connected to each post/stanchion 10 by the over lapping of fixed length guard rail tangs 30*b*. Tangs 30*b* can be similarly fixably fastened to their respective guard rails 30 like those in the preceding embodiment using weldment, and the like. A long bolt 6*c* is inserted through holes in both guard rail tangs 30*b* into the long term stanchion mounting points 6*a*. Each of the mounting points 6*a* can be nuts with internal threaded holes where the nuts 6*a* can be fixably attached to the sides of the post/stanchion 10 by weldment, and the like. This described embodiment will provide an economical temporary guardrail system using simple fixed length guard rails 30 and the simple fixed mounting point stanchions 10, and 20 that is ideally suited for long straight runs of guard rail protection.

Figure 21:
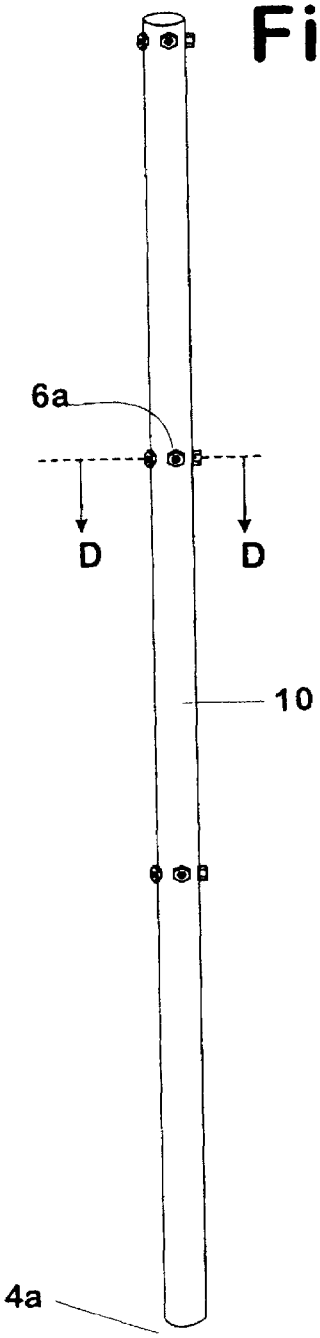
FIG. 21 is a perspective view of a novel long term tall post/stanchion
Figure 22:
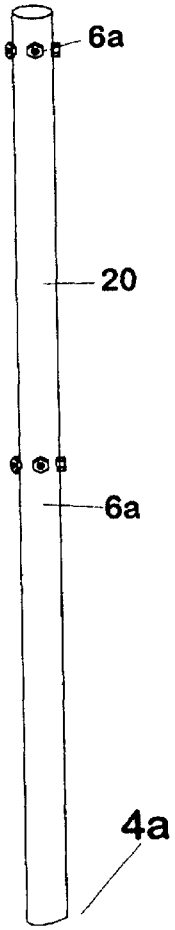
FIG. 22 is a perspective view of a novel long term short post/stanchion.
Figure 23:
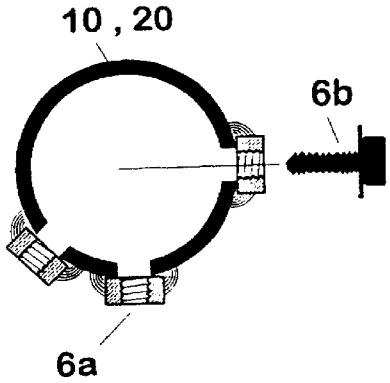
FIG. 23 is a top cross-sectional view of the mounting points used in the long term stanchion of FIG. 21 along arrow D.

FIG. 23 illustrates a top cross-sectional view of the post/stanchion 10 of FIG. 21 showing possible multiple fixed mounting point combinations. Using three or more mounting points as configured in this embodiment at each row of the vertical mounting points on posts/stanchions 10, 20 can result in the potential of attaching a guard rails 30 at 180 degrees, 90 degrees, and 45 degree angles.

It can be appreciated that these mounting points are similarly vertically spaced as to the mounting points on the more flexible pivot stanchions 1, 2 as shown in FIGS. 2–3. Because of the similar vertical spacing, it is apparent that fixed mounting point posts/stanchions 10, 20 can be intermingled with flexible rotating mounting point stanchions 1, 2. This enables complete versatility when assembling guard rail systems in commercial sites for long term installations.

Figure 24:
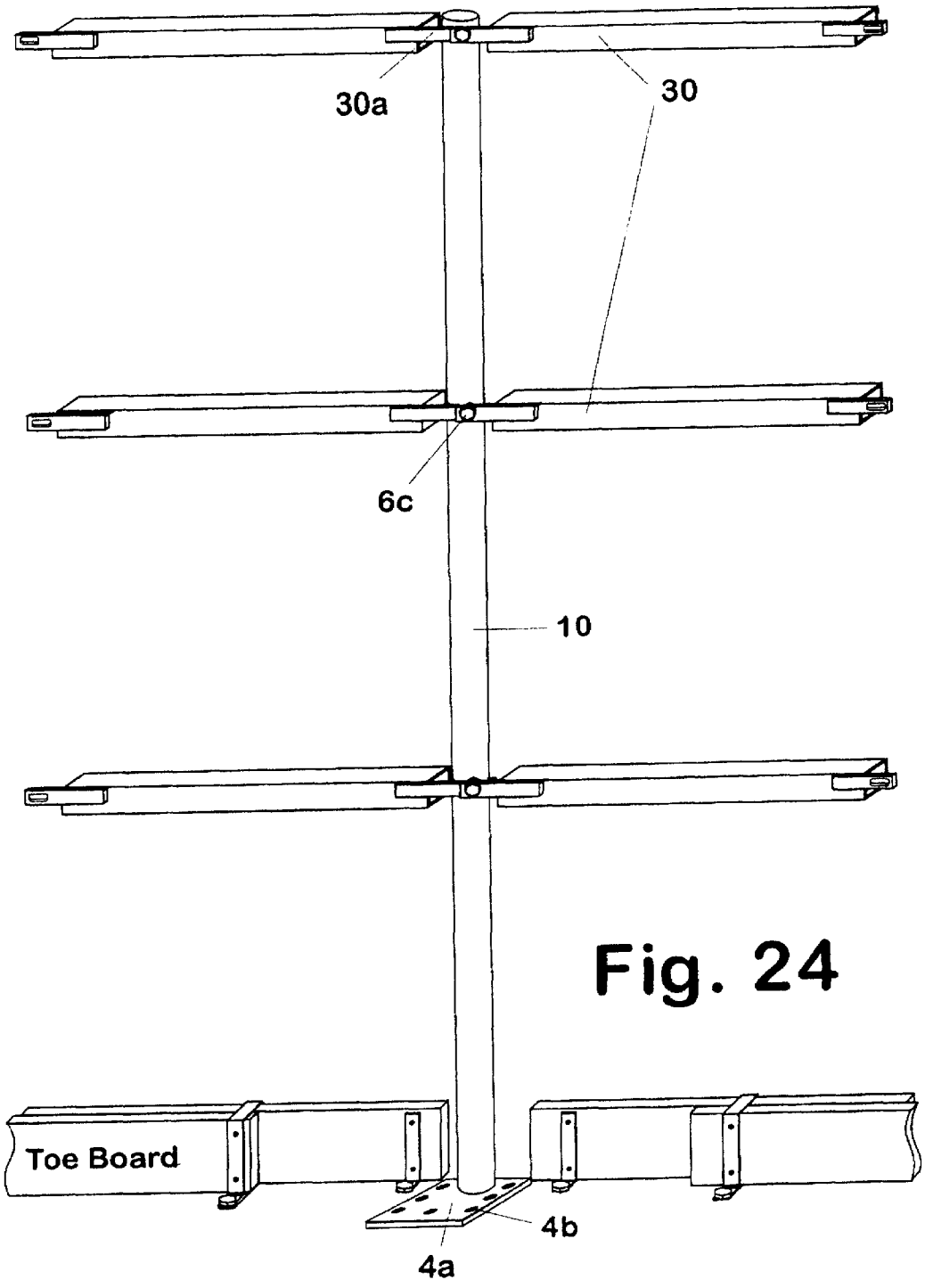
FIG. 24 is a perspective view of a typical long term guard rail installation showing a tall long term post/stanchion of FIG. 21 with anchor plate of FIG. 11*a*, toe boards of FIG. 20, and fixed length guard rails shown in preceding figures.

It should be noted from FIG. 24 that the toe board of FIGS. 19–20 can be used with the fixed mounting point posts/stanchions 10, 20.

Referring to FIGS. 26*a*–26*b*, a wall mounting plate 40 can be affixed with previously described fasteners such as bolts, and the like, through mounting holes 40*b* to a balcony wall, or window and thus provide a guard rail mounting point on plate bracket 40*a* without any attachment to the deck. FIG. 26*b* illustrates the attachment of guard rail 3, 3*a*, or 30 to wall mounting plate by the insertion of bolt 6*b*.

Figure 27:
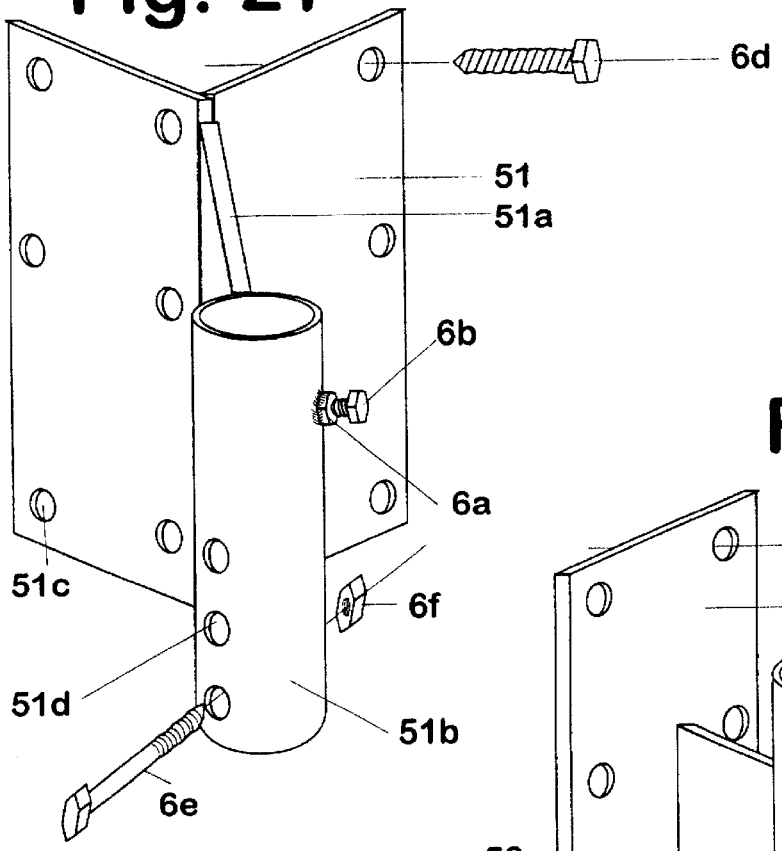
FIG. 27 is a perspective view of a novel wall anchor plate that can be used with the system.
Figure 28:
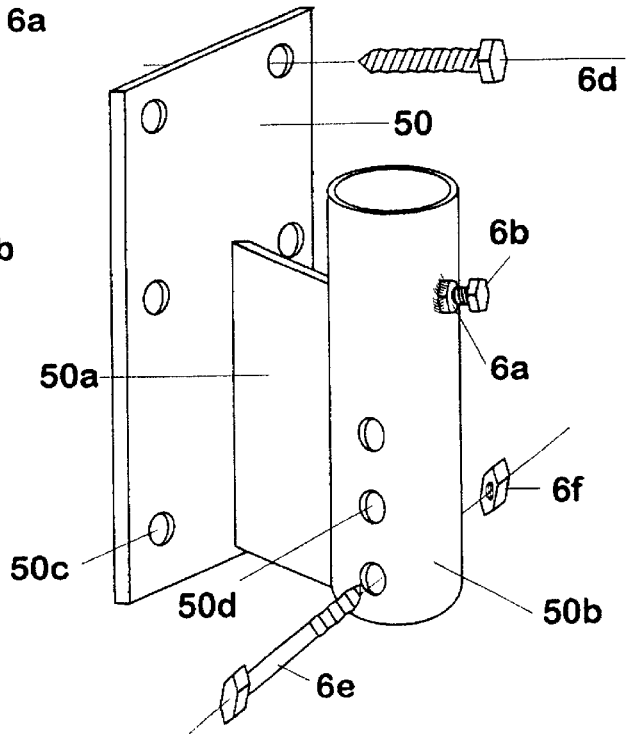
FIG. 28 is a perspective view of a wall corner anchor plate that can be used with the system.
Figure 29:
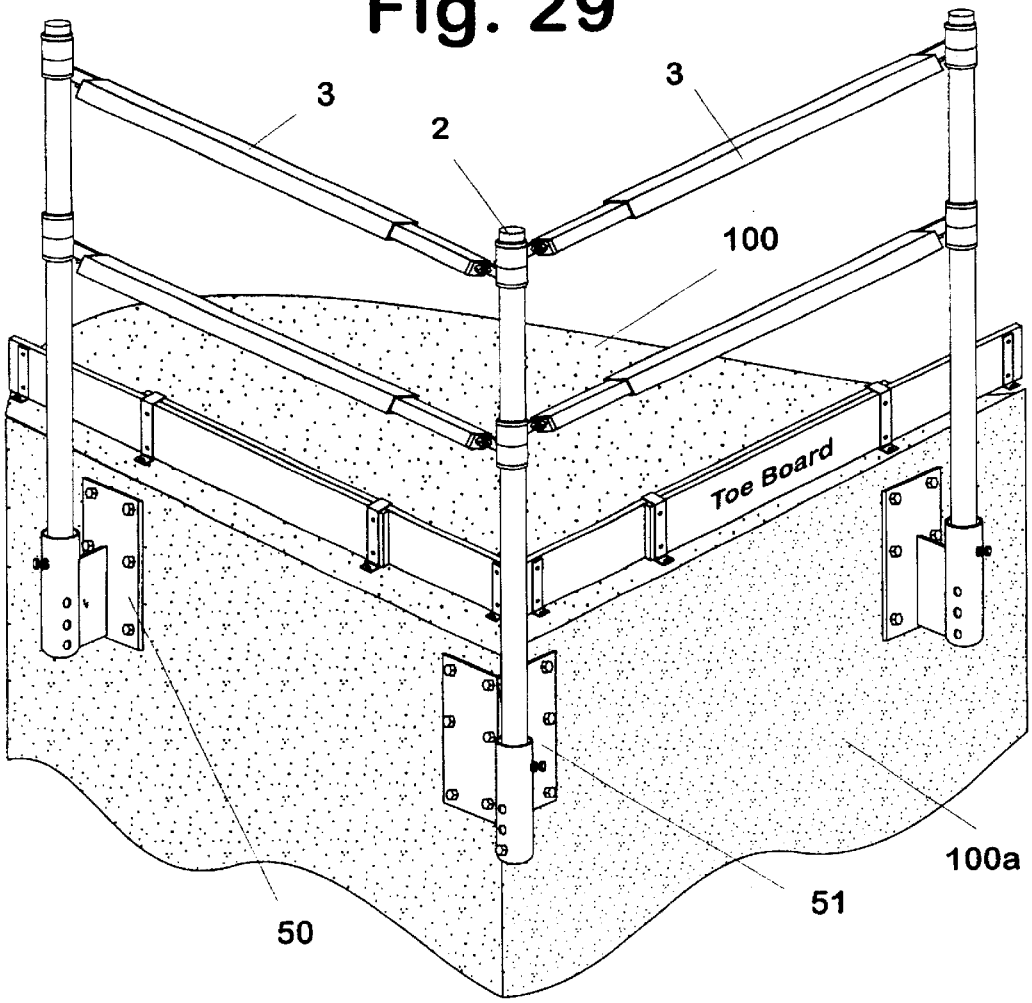
FIG. 29 is a perspective view of using the wall anchor plate of FIG. 28 and corner plate of FIG. 27.

Referring to FIG. 29 wall anchor plates 50 and 51 shown in more detail in respect to FIGS. 27–28 are attached to the vertical flat and corner surfaces of a wall 100*a* enabling the insertion of a post/stanchion 2 into respective cups attached to the plates.

FIG. 27 illustrates the preferred embodiment where wall anchor receiver cup 51*b* is attached to wall corner anchor extension 51*a* which is attached to perpendicular angled wall corner anchor plate 51. These connections typically being made by weldment, and the like. Wall corner anchor plate 51 can be firmly attached to a wall 100*a*(FIG. 29) by the fasteners 6*d* such as lag bolts, and the like being inserted through mounting holes 51*c* and into wall 110*a*. It will be appreciated that wall anchor receiver cup adjustment holes 50*d* enable long bolts 6*e* to be inserted into any of the holes 50*d* allowing the adjustment of the base elevation of the stanchion that would be inserted into wall corner anchor receiver cup 51*b*. It should also be appreciated that bolt 6*b* can be threaded through machine nut 6*a* and that said nut 6*a* has been welded in place over a hole in said receiver cup 51*b*. Thus, allowing the bolt 6*b* to be tightened through the nut 6*a*, through the wall of the receiver cup 51*b* and hence to come into contact with the inserted post/stanchion. Thus, tightening bolt 6*b* firmly against the inserted post/stanchion will firmly lock the post/stanchion in place.

FIGS. 28 and 29 show a preferred embodiment where wall anchor receiver cup 50*b* is attached to wall anchor extension 50*a* which is attached to wall anchor plate 50. These connections typically being made by weldment. Wall anchor plate 50 can be firmly attached to wall 100*a* by fasteners 6*d* such as lag bolts, and the like, being inserted through mounting holes 50*c* and into wall 100*a*. It will be appreciated that wall anchor receiver cup adjustment holes 50*d* enable a long bolt 6*e* to be inserted into any of the holes 50*d*, allowing the adjustment of the base elevation the post/stanchion that would be inserted into a wall corner anchor receiver cup 50*b*. It should also be appreciated that bolt 6*b* can be threaded through machine nut 6*a* and that said nut 6*a* has been welded in place over a hole in said receiver cup. Thus, allowing the bolt 6*b* to be tightened through the nut 6*a*, through the wall of said receiver cup 50*b* and hence to come into contact with the inserted post/stanchion. Thus, tightening bolt 6*b* firmly against the inserted stanchion firmly locks the post/stanchion in place.

Referring to FIG. 29, it can be appreciated that wall anchor plate 50 and corner anchor plate 51 enables the guard rail system to be installed in such a manner as to not require mounting to the deck 100.

Figure 30:
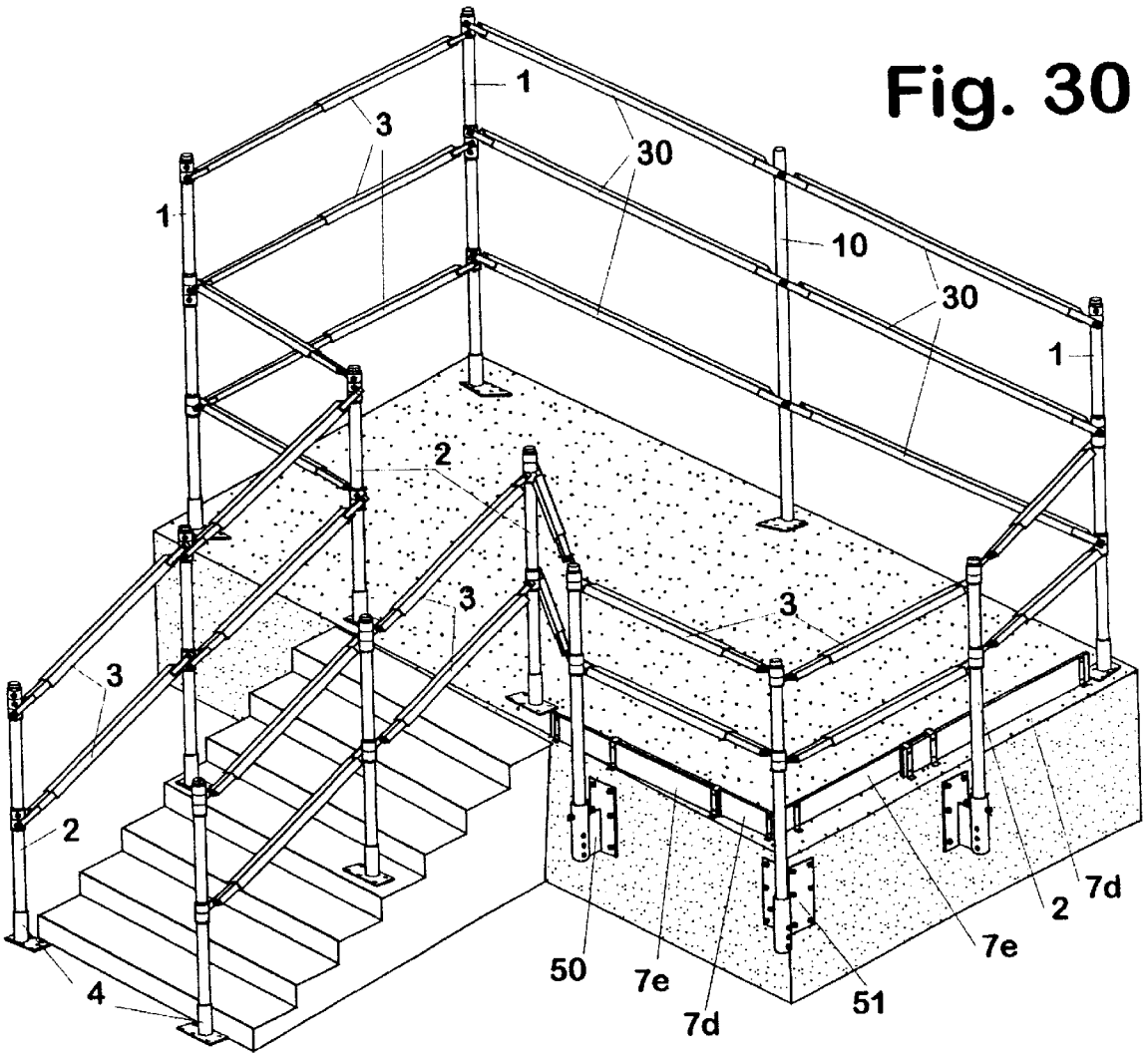
FIG. 30 is a perspective view of the temporary guard rail system of preceding figures all in use.

FIG. 30 is a perspective view of using the novel features of the subject invention as temporary and long-term guard rails for both a horizontal and inclined surfaces.

The terms "upper", "lower", "side", "top", "bottom" and so forth have been used herein merely for convenience to describe the present invention and its parts as oriented in the drawings. It is to be understood, however, that these terms are in no way limiting to the invention since such invention may obviously be disposed in different orientations when in use. Additionally, the terms posts and stanchions are interchangeably used to describe the vertical supports.

Although the preferred embodiments have been described for use as a temporary system, the invention can be assembled for long term use as needed.

The subject invention system can be used in horizontal, vertical and any inclined angled surfaces where guard rails are needed.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A temporary guardrail system using rotatable side-rail connecting collars, comprising:

a first post/stanchion having two adjacent rotatable collars solely on top of the first post/stanchion, three adjacent rotatable collars approximately midway on the first post/stanchion; and two adjacent rotatable collars toward a bottom portion of the first post/stanchion, each of the collars having first connecting means thereon;

a second post/stanchion having two adjacent rotatable collars solely on top of the second post/stanchion, three adjacent rotatable collars approximately midway on the second post/stanchion; and two adjacent rotatable collars toward a bottom portion of the second post/stanchion, each of the collars having second connecting means thereon; and a first guard rail being interchangeably attached to any one of the first connecting means and to any one of the second connecting means, wherein the first post/stanchion and the second post/stanchion with guard rails can be mounted on both horizontal, vertical and inclined surfaces without using any protruding fasteners that can cause lacerations or clothing snag hazards.

2. The temporary guardrail system of claim 1, wherein the first set of spaced apart rotatable collars and the second set of rotatable collars can rotate up to 360 degrees.

3. The temporary guardrail system of claim 1, further comprising:

a third post/stanchion having three adjacent rotatable collars solely on top of the third post/stanchion, and two adjacent rotatable collars approximately midway on the third post/stanchion, each of the collars having third connecting means thereon; and a second guard rail being interchangeably attached to any one of the second connecting means and any one of the third connecting means, wherein the third post/stanchion can be mounted on both horizontal, vertical and inclined surfaces.

4. The temporary guardrail system of claim 1, wherein at least one of the first connecting means and the second connecting means includes:

an internally threaded hole on at least one of the first post/stanchion and the second post/stanchion.

5. The temporary guardrail system of claim 4, wherein the internally threaded hole includes:

a nut.

6. The temporary guardrail system of claim 4, wherein the at least one of the first connecting means and the second connecting means includes:

a threaded rod for being inserted therein connecting the first guard rail to at least one of the first post/stanchion and the second/post stanchion.

7. The temporary guardrail system of claim 1, further including:

means for locking at least one of the rotatable collars to at least one of the first post/stanchion and the second post/stanchion in order to reduce structural play.

8. The temporary guardrail system of claim 1, further comprising:

an extendible toe guard attached to a bottom portion between the first post/stanchion and the second post/stanchion, for preventing items from falling outside of the system.

9. The temporary guardrail system of claim 1, further comprising:

a mounting plate for supporting at least one of the first post/stanchion and the second post/stanchion to a surface without using tiedown straps.

10. The temporary guardrail system of claim 9, wherein the mounting plate includes:

a drain slot for allowing moisture and fluid to drain therefrom.

11. The temporary guardrail system of claim 10, further comprising:

an anchor load distribution plate beneath the mounting plate for further distributing the load of the system thereon.

12. The temporary guardrail system of claim 1, wherein the first guard rail includes:

telescoping longitudinal lengths; and means within the lengths to lock the longitudinal lengths to selected extensions.

13. The temporary guardrail system of claim 12, wherein the lock means includes:

a first segment connected to a second segment, the first segment for abutting against a first longitudinal length and the second segment for abutting against a second longitudinal length, wherein the first longitudinal length and the second longitudinal length telescope with one another.

14. The temporary guardrail system of claim 13, wherein the lock means includes:

a rotatable rod actuated on one end of the first guard rail.

15. A temporary guardrail system for attaching siderails to existing surfaces, comprising:

a first post/stanchion having three adjacent rotatable collars solely on top of the first post/stanchion and two adjacent rotatable collars approximately midway on the first post/stanchion, each of the collars allowing members to be pivotally mounted thereon;

a second post/stanchion having three adjacent rotatable collars solely on top of the second post/stanchion and two adjacent rotatable collars approximately midway on the second post/stanchion, each of the collars allowing members to be pivotally mounted thereon; and a first guard rail being interchangeably attached to any one of the collars on the first post/stanchion and to any one of the collars on the second post/stanchion, wherein the system can be assembled and disassembled on horizontal, vertical and inclined surfaces without using any protruding fasteners that can cause lacerations or clothing snag hazards.

16. The temporary guardrail system of claim 15, wherein the surface mounting means includes:

a flat surface mounting plate for mounting on wall surfaces.

17. The temporary guardrail system of claim 15, wherein the surface mounting means includes:

an angled surface mounting plate for mounting on corner surfaces.

18. The temporary guardrail system of claim 15, wherein each of the collars includes:

spaced apart rows of internally threaded holes.

19. The temporary guardrail system of claim 15, further comprising:

a third post/stanchion having two adjacent rotatable collars solely on top of the third post/stanchion, three adjacent rotatable collars approximately midway on the third post/stanchion; and two adjacent rotatable collars toward a bottom portion of the third post/stanchion, each of the collars having second connecting means thereon; and a third guard rail being interchangeably attached to any one of the collars on the second post/stanchion and to any one of the collars on the third post/stanchion.

20. A temporary guardrail system comprising:

a first post/stanchion having a first set of spaced apart connecting points;

a second post/stanchion having a second set of spaced apart connecting points, wherein at least one of the first set of spaced apart connecting points and at least one of the second set of spaced apart connecting points include at least one rotatable collar, the at least one rotatable collar having a threaded opening therethrough substantially perpendicular to the first and the second posts/stanchions;

a first guard rail being attached to at least one of the first connecting points and to at least one of the second connecting points, the first guard rail having one end for locking onto the at least one rotatable collar of each of the first and the second posts/stanchions; and a fastener threadably inserted into the threaded opening of the at least one rotatable collar for locking rotation of the at least one rotatable collar to the first and the second posts/stanchions.

21. A temporary guardrail system comprising:

a first post/stanchion having a first set of spaced apart connecting points;

a second post/stanchion having a second set of spaced apart connecting points; and a first guard rail being attached to at least one of the first connecting points and to at least one of the second connecting points, the first guard rail having a telescoping longitudinal length and a rotatable member actuated at one end of the guard rail for locking a position of the telescoping longitudinal length, wherein the rotatable member further includes:

an external member;

an internal member; and a rotatable rod having one end outside the external member, and another end fixably attached to the internal member.

22. The temporary guardrail system of claim 21, wherein the rotatable member further includes:

a nut for locking the one end of the rotatable rod.

* * * * *